US008776397B2

(12) United States Patent
Borel et al.

(10) Patent No.: US 8,776,397 B2
(45) Date of Patent: Jul. 15, 2014

(54) FOOTWEAR WITH IMPROVED BOTTOM ASSEMBLY

(75) Inventors: René Borel, Saint-Sylvestre (FR); Patrick Leick, Villaz (FR); Pascal Stryjak, Saint-Eusèbe (FR)

(73) Assignee: Salomon S.A.S., Metz-Tessy (FR)

( * ) Notice: Subject to any disclaimer, the term of this patent is extended or adjusted under 35 U.S.C. 154(b) by 777 days.

(21) Appl. No.: 12/472,784

(22) Filed: May 27, 2009

(65) Prior Publication Data

US 2009/0320330 A1 Dec. 31, 2009

(30) Foreign Application Priority Data

Jun. 25, 2008 (FR) ..... 08 03570

(51) Int. Cl.

| | |
|---|---|
| ***A43B 13/18*** | (2006.01) |
| ***A43B 21/26*** | (2006.01) |
| ***A43B 13/12*** | (2006.01) |
| ***A43B 13/16*** | (2006.01) |

(52) U.S. Cl.

CPC ..... *A43B 13/12* (2013.01); *A43B 13/18* (2013.01); *A43B 13/16* (2013.01); *A43B 13/181* (2013.01)

USPC ..... 36/28; 36/103; 36/31

(58) Field of Classification Search

CPC ..... A43B 13/12; A43B 13/14; A43B 13/18; A43B 13/188; A43B 13/16; A43B 13/186; A43B 13/026

USPC ..... 36/102, 103, 107, 25 R, 31, 15, 35 R, 28, 36/30 R

See application file for complete search history.

(56) References Cited

U.S. PATENT DOCUMENTS

| | | | | |
|---|---|---|---|---|
| 5,317,822 | A * | 6/1994 | Johnson | 36/101 |
| 5,477,593 | A | 12/1995 | Leick | |
| 6,023,859 | A * | 2/2000 | Burke et al. | 36/105 |
| 6,497,058 | B2 * | 12/2002 | Dietrich et al. | 36/69 |
| 6,775,930 | B2 * | 8/2004 | Fuerst | 36/103 |
| 6,931,766 | B2 * | 8/2005 | Greene | 36/101 |
| 6,944,973 | B2 * | 9/2005 | Goodwin | 36/29 |
| 7,082,702 | B2 * | 8/2006 | Cretinon | 36/88 |
| 7,159,339 | B2 | 1/2007 | Mathieu et al. | |
| 7,243,445 | B2 * | 7/2007 | Manz et al. | 36/103 |
| 7,451,557 | B2 * | 11/2008 | McDonald et al. | 36/100 |
| 7,464,489 | B2 * | 12/2008 | Ho | 36/28 |
| 7,467,484 | B2 * | 12/2008 | Chang et al. | 36/30 R |
| 7,647,709 | B2 * | 1/2010 | Reilly et al. | 36/30 R |
| 7,707,745 | B2 * | 5/2010 | Schindler et al. | 36/29 |
| 7,794,368 | B2 * | 9/2010 | Rutherford | 482/79 |

(Continued)

FOREIGN PATENT DOCUMENTS

| | | |
|---|---|---|
| EP | 1 447 019 A1 | 8/2004 |
| EP | 1 844-673 A1 | 10/2007 |
| FR | 2 685 173 A1 | 6/1993 |
| FR | 2 914 156 A1 | 10/2008 |

*Primary Examiner* — Jila M Mohandesi

(74) *Attorney, Agent, or Firm* — Greenblum & Bernstein, P.L.C.

(57) ABSTRACT

An article of footwear which includes an outer bottom assembly, the bottom assembly including an outsole and a reinforcement layer. A damping layer is positioned between the outsole and the reinforcement layer, and at least one flange connects the outsole to the reinforcement layer.

39 Claims, 10 Drawing Sheets

(56) References Cited

U.S. PATENT DOCUMENTS

| | | | | |
|---|---|---|---|---|
| 7,946,059 | B2 * | 5/2011 | Borel | 36/28 |
| 7,946,060 | B2 * | 5/2011 | Rosenbaum | 36/30 R |
| 2001/0010129 | A1 * | 8/2001 | Russell | 36/27 |
| 2004/0168350 | A1 | 9/2004 | Mathieu et al. | |
| 2006/0277798 | A1 * | 12/2006 | Reilly et al. | 36/76 HH |
| 2007/0068046 | A1 | 3/2007 | Mathieu et al. | |
| 2007/0193065 | A1 * | 8/2007 | Nishiwaki et al. | 36/27 |
| 2007/0240331 | A1 | 10/2007 | Borel | |

* cited by examiner

FOOTWEAR WITH IMPROVED BOTTOM ASSEMBLY

CROSS-REFERENCE TO RELATED APPLICATION

The instant application is based upon the French priority Patent Application No. 08.03570, filed Jun. 25, 2008, the disclosure of which is hereby incorporated by reference thereto, and the priority of which is hereby claimed under 35 U.S.C. §119.

BACKGROUND OF THE INVENTION

1. Field of the Invention

The invention relates to an article of footwear, such as a shoe, in particular a sports shoe, and more particularly a shoe intended for athletic events such as race walking.

2. Background Information

Footwear of the aforementioned type can be used in disciplines such as walking or running on flat or mountainous terrain, mountaineering, snowboarding, skiing, snowshoeing, roller skating, skateboarding, cycling, ball-playing sports, and the like.

An article of footwear, or shoe, can have a low upper, a high upper, or even a mid-upper. The shoe can also be relatively flexible or, conversely, more rigid. However, it is desirable for the shoe sole, in any case, to provide a certain comfort, as well as a certain precision in the transmission of sensory information or impulses related to support forces, whether transmitted to or received by the wearer.

In certain sports shoes, the outer bottom assembly includes an outsole and a reinforcement layer. The outsole generally includes rubber for an easier grip on the ground. A reinforcement layer of such outer bottom assembly contributes to connecting the bottom assembly to the upper of the shoe. This layer is generally inextensible or slightly extensible, which provides stability to the shape of the bottom assembly.

Shoes in which the outer bottom assembly includes an outsole and a reinforcement layer offer a good precision in the transmission of information or impulses. However, they are known not to provide adequate comfort, in the sense that the impulses are not always sufficiently damped. Moreover, certain areas of the outsole wear out quickly. Walking or running also appear to cause fatigue for the user.

Proposals have been made for structural modifications in such bottom assemblies, in particular to improve comfort.

For example, the document FR 2 685 173 proposes an outer bottom assembly that includes an outsole provided to contact the ground, a comfort layer arranged directly beneath the foot, as well as a reinforcement layer inserted between the outsole and the comfort layer.

The shoe according to the document FR 2 685 173 has improved comfort in comparison to the prior art. However, the precision in the transmission of information or impulses is sometimes insufficient, in the sense that the information and impulses are diffused in the bottom assembly. This is the case with point supports on rocks, for example. Moreover, it is noted once again that certain areas of the outsole wear out quickly. It appears here as well that walking causes fatigue for the user.

SUMMARY OF THE INVENTION

In view of the above, the invention provides an improved bottom assembly for an article of footwear, or shoe, and in particular to provide a certain comfort in the area of the sole, while offering a good precision in the transmission of sensory information or impulses related to support forces. In other words, the invention optimizes these two paradoxical characteristics, namely comfort and precision.

The invention also provides for a slowing down of the wear on the areas of the outsole that experience the greatest stress.

In addition, the invention reduces the wearer's fatigue caused by walking.

To this end, the invention provides for an article of footwear, or shoe, having an outer bottom assembly that includes an outsole and a reinforcement layer.

The damping layer of the shoe according to the invention is positioned between the outsole and the reinforcement layer, and at least one flange connects the outsole to the reinforcement layer.

As arranged, the damping layer separates the outsole from the reinforcement layer. However, a flange locally creates a direct connection between the outsole and the reinforcement layer. In fact, the invention provides different properties to various portions or zones of the bottom assembly. This means that certain portions are relatively flexible; these are of course portions that have no flanges. As a corollary, the portions provided with flanges are more rigid. The concepts of flexibility and rigidity are relative.

Optimization of the mechanical properties of the bottom assembly is among the advantages which arise from such a structure. The damped zones and rigidified zones are distributed to optimize the behavior of the shoe, as will be better understood from the description which follows.

Another advantage is a slowing of the wear on the more flexible portions of the bottom assembly. Indeed, in the area in which only the damping layer connects the outsole to the reinforcement layer, the outsole follows the deformations of the damping layer. For example, when strongly pressed, both the outsole and the damping layer become deformed. In other words, it can be said that the damping layer provides freedom of deformation to the outsole. As a result, the outsole is less biased in shearing or in friction. This is particularly true when the outsole is fitted with studs.

Another advantage observed, for the bottom assembly according to the invention, is the ability to store and then to restore at least part of the energy generated during the foot rolling movement. Indeed, a rolling movement tensions the outsole. It is the distance between the outsole and the reinforcement layer that enables the tensioning, which is all the more substantial as the damping layer is thick. At the end of the foot rolling movement, i.e., at the moment when the shoe leaves the ground, the energy generated by the tension of the outsole tends to return the bottom assembly to its initial shape. Indeed, this is a spring effect provided to the bottom assembly by the outsole. This effect propels the shoe in the walking direction, i.e., forward. An advantage resulting from this is a reduction in the user fatigue, as he/she needs to produce less energy for an equivalent stride.

BRIEF DESCRIPTION OF DRAWINGS

Other characteristics and advantages of the invention will be better understood from the description that follows, with reference to the annexed drawings illustrating, by way of non-limiting embodiments, how the invention can be embodied, and in which.

DETAILED DESCRIPTION OF THE INVENTION

The first embodiment described hereinafter relates more particularly to footwear intended for walking or running on flat or uneven terrain. However, the invention applies to other fields, such as those mentioned above.

The first embodiment is described hereinafter with reference to FIGS. 1 to 10.

Figure 1:
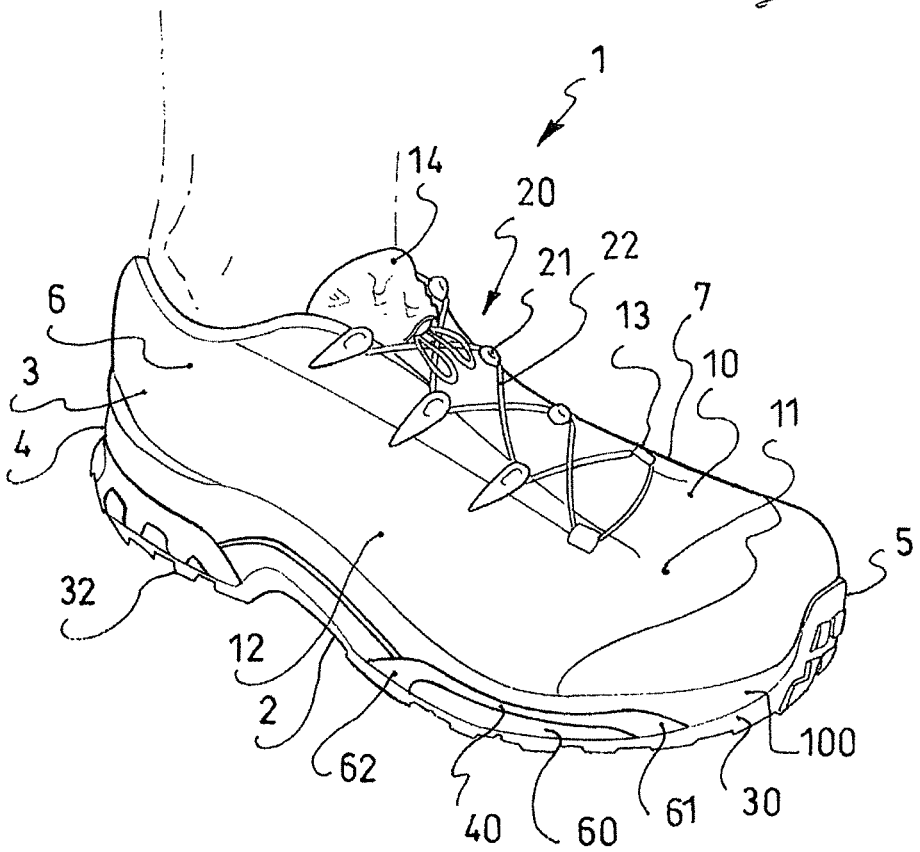
FIG. 1 is a perspective front view of a shoe according to a first embodiment of the invention.

As shown in FIG. 1, a running shoe is provided to receive the user's foot.

In a known fashion, the shoe 1 includes an outer bottom assembly 2 and an upper 3 arranged on the bottom assembly. The shoe 1 extends lengthwise between a rear end, or heel 4, and a front end, or tip 5, and widthwise between a lateral side 6 and a medial side 7. The terms "shoe" and "footwear," as used herein, are intended to be synonymous.

As shown, the upper 3 includes a lower portion 10, provided to surround the foot, but has no upper portion to extend over and above the region of the wearer's ankle. However, the upper could also be provided to include such an upper portion. More particularly, the shoe of FIG. 1 can be considered as having a low upper, rather than a mid-upper (i.e., extending upward to the area of the ankle) or a high upper (i.e., extending upward beyond the ankle).

The shoe 1 is structured to allow for a good foot rolling movement during walking, transmissions of sensory information, and transmissions of impulse forces for supports or landings. In this regard, therefore, the outer bottom assembly 2 and the upper 3 are relatively flexible to facilitate such rolling movement.

Alternatively, however, the shoe can be provided to be more rigid to facilitate the practice of certain sports, such as climbing or cycling.

The upper 3 includes a lateral quarter 12, a medial quarter 13, and a tongue 14. The tongue 14 connects the quarters 12, 13 to one another in order to provide the upper 3 with its continuity. However, the tongue can be omitted in a particular embodiment of the invention. In such a case, the quarters 12, 13 can remain separate or they can be superimposed or overlap.

The upper 3 is affixed to the bottom assembly 2, in the area of the periphery of the bottom assembly. The affixing, or connection, is done using an adhesive. However, the connection between the upper and the bottom assembly can be accomplished otherwise, such as with stitching or with the combination of an adhesive and stitching.

A tightening device 20 is provided to tighten the upper 3 and to allow the upper to be loosened. The tightening device 20 includes keepers 21 or lace guides, for example, arranged on the lateral 12 and medial 13 quarters, as well as a lace 22. The lace can include one or more strands. The lace 22 follows a path that guides it alternately from one quarter 12, 13 to the other, and can be reversibly tightened and locked in place by means of any known mechanisms or structural expedients. For example, merely a knot could be employed, or a lace blocking device could be used, such as disclosed in U.S. Pat. No. 5,477,593, the disclosure of which is hereby incorporated by reference thereto in its entirety.

Figure 2:
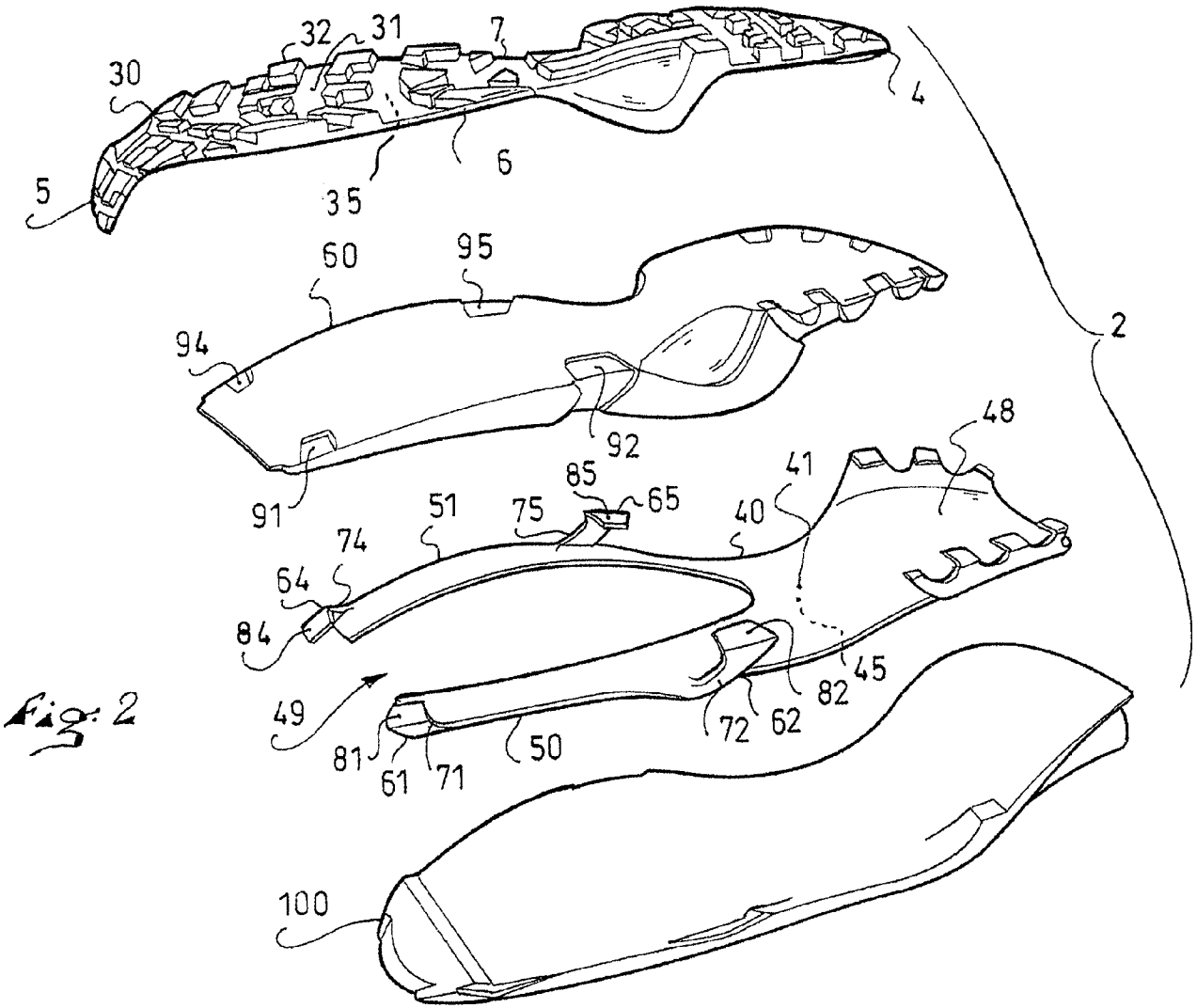
FIG. 2 is an exploded perspective view of a bottom assembly of the shoe according to the first embodiment.

The outer bottom assembly 2 is illustrated in greater detail in the exploded perspective view of FIG. 2.

In a known manner, the bottom assembly 2 includes an outsole 30 provided to cooperate with the ground. The sole 30 extends longitudinally from the rear end 4 to the front end 5 of the shoe, and transversely from the lateral side 6 to the medial side 7. The outsole 30 includes a wear surface 31. It is this surface 31 that exerts a pressure force on the ground. Although not limiting to the invention, the wear surface 31 is provided with studs 32, or tread blocks, which form a relief, i.e., provide a plurality of projections, to improve the grip of the shoe with respect to the ground. Opposite the wear surface 31, the outsole 30 includes a connecting surface 35, which is adapted to be associated with the other elements of the bottom assembly 2, as described in greater detail below.

The outsole 30 is made from any appropriate material. For example, the outsole 30 can include rubber or a rubber-like material, or, in another embodiment, it can be made entirely of rubber or rubber-like material. This promotes wear resistance, in particular resistance to friction wear. Rubber and other similar materials have very elastic properties.

The outer bottom assembly 2 also includes a reinforcement layer 40, which extends from the rear end 4 of the shoe toward the front end 5, and transversely from the lateral side 6 to the medial side 7. The reinforcement layer 40 includes a lower surface 41 facing the outsole 30, as well as an upper surface 45 facing the upper 3. The reinforcement layer 40 includes a rear portion 48 that extends beneath the user's heel, as well as a front portion 49 that extends beneath the metatarsus, or beneath the metatarsus and the toes. In the illustrated embodiment, the rear portion 48 and the front portion 49 extend one another, i.e., they are co-extensive. More particularly, they can be made as a unitary piece, as shown. In a non-limiting manner, the front portion 49 includes a lateral branch 50 and a medial branch 51, which form a forwardly extending fork, i.e., a forwardly open fork. This structure, as further described below, enables the lateral side 6 and the medial side 7 of the shoe to behave with a certain independence. However, any other suitable structure can be alternatively provided for the reinforcement layer 40. For example, the front portion 49 could extend continuously from the lateral side 6 to the medial side 7.

In its construction, the reinforcement layer 40 includes a substantially inextensible material, or one or more plastic materials. For example, polyurethane or polyamide are suitable. This renders the reinforcement layer 40 flexible and substantially inextensible. Thus, the bottom assembly 2 has a certain structural stability, while allowing for a free foot rolling movement.

According to the invention, a damping layer 60 is positioned between the outsole 30 and the reinforcement layer 40, and at least one flange 61, 62, 64, 65 connects the outsole 30 to the reinforcement layer 40. This defines flexible zones and more rigid zones of the bottom assembly. Damping is substantial in the flexible zones which do not have such flanges. As a corollary, damping is reduced, even nonexistent, in a zone provided with a flange. The invention provides a certain comfort where necessary, as well as support stability where also necessary. In other words, various portions of the bottom assembly 2 are assigned respective specific functions.

The damping layer 60 owes its mechanical properties to its natural characteristics. The damping layer 60 is provided to include a foam made of a damping material, such as ethyl-vinyl-acetate (EVA), or a rubber foam, or any equivalent. The cells of the foam enable it to deform reversibly, in particular in compression. Consequently, the layer 60 absorbs impulses or impacts.

According to the first embodiment of the invention, the shoe 1 includes four flanges 61, 62, 64, 65 located toward the front, i.e., in the area of the toes and the metatarsus. More particularly, the shoe 1 includes a first lateral flange 61, a second lateral flange 62, a first medial flange 64, and a second medial flange 65. The first lateral 61 and medial 64 flanges are each located in the area of the toes. In a non-limiting manner, the flanges 61, 64 are transversely opposite one another. The second lateral 62 and medial 65 flanges are located in the area of the metatarsus. These flanges 62, 65 are also opposite one another transversely. In fact, the flanges 61, 62, 64, 65 are arranged in pairs extending transversely of the shoe, i.e., at an angle to a vertical longitudinal plane of the shoe, such as perpendicular thereto.

According to the first embodiment, each flange 61, 62, 64, 65 is structured in the same manner. Each flange 61, 62, 64, 65 includes a first portion 71, 72, 74, 75, respectively, forming a leg, as well as a second portion 81, 82, 84, 85 forming a base. A leg and a base extend one another in order to give an L-shape to a flange 61, 62, 64, 65. The leg extends from the reinforcement layer 40 downwardly toward the outsole. For example, the legs 71, 72, 74, 75 are perpendicular, or generally perpendicular, to the reinforcement layer 40, and the bases 81, 82, 84, 85 are parallel, or substantially parallel, to this same layer. In the illustrated embodiment, a leg and a base form a unitary element, i.e., a one-piece element. In fact, each flange 61, 62, 64, 65, together with the front portion 49, forms a unitary element. On the whole, the reinforcement layer 40, together with the rear 48 and front 49 portions, as well as the flanges 61, 62, 64, 65, form a unitary element in the illustrated embodiment. This facilitates the manufacture of the bottom assembly 2. Such element is manufactured by any process, such as molding, injection, and the like. A construction in which the flanges are affixed to the reinforcement layer, without forming a unitary element therewith, is also within the scope of the invention. In a particular, non-limiting embodiment, the flanges are made of the same material as the reinforcement layer.

Each leg 71, 72, 74, 75 is flush with a lateral side 6 or a medial side 7, and each base 81, 82, 84, 85 penetrates transversely within the bottom assembly in a direction toward a longitudinal median plane of the shoe. In fact, the damping layer 60 is structured and arranged to receive the flanges 61, 62, 64, 65. To this end, the damping layer 60 has a series of notches 91, 92, 94, 95 each provided to house a flange 61, 62, 64, 65. Thus, the damping layer has a first lateral notch 91, a second lateral notch 92, a first medial notch 94, and a second medial notch 95. The first lateral notch 91 receives the first lateral flange 61, and so on. Each notch 91, 92, 94, 95 houses a respective flange 61, 62, 64, 65, i.e., a respective leg and a base of such flanges. Consequently, each leg is flush with the side 6, 7 of the shoe on which it is located. Each leg 71, 72, 74, 75 borders the damping layer 60 transversely. This allows the leg to be visible but especially optimizes its action, as further described below. Each base extends into the bottom assembly in the damping layer 60, and is in contact with the outsole 30. In this sense, each flange directly connects the reinforcement layer 40 to the outsole 30.

The outsole 30, the damping layer 60, and the reinforcement layer 40 are affixed to one another by one or more of any of a number of expedients, such as an adhesive or any equivalent for such connection. In addition, the outer bottom assembly can be provided with a connecting layer 100 positioned between the reinforcement layer 40 and the upper. The layer 100, connected to the reinforcement layer 40 and, between the arms 50, 51, to the damping layer 60, also serves to increase comfort in the shoe. The layer 100 is not absolutely necessary. The layer 100 can also include a foam made of a damping plastic material, such as ethyl-vinyl-acetate, or a foam made of another material.

Thus, according to the first embodiment of the invention, the bottom assembly 2 includes either three layers 30, 40, 60 or four layers 30, 40, 60, 100. These numbers are not limiting: one or more layers could be added, being inserted between or superimposed on the others.

The role of the components of the bottom assembly 2 is explained hereinafter, in particular with respect to FIGS. 3 to 10.

Figure 3:
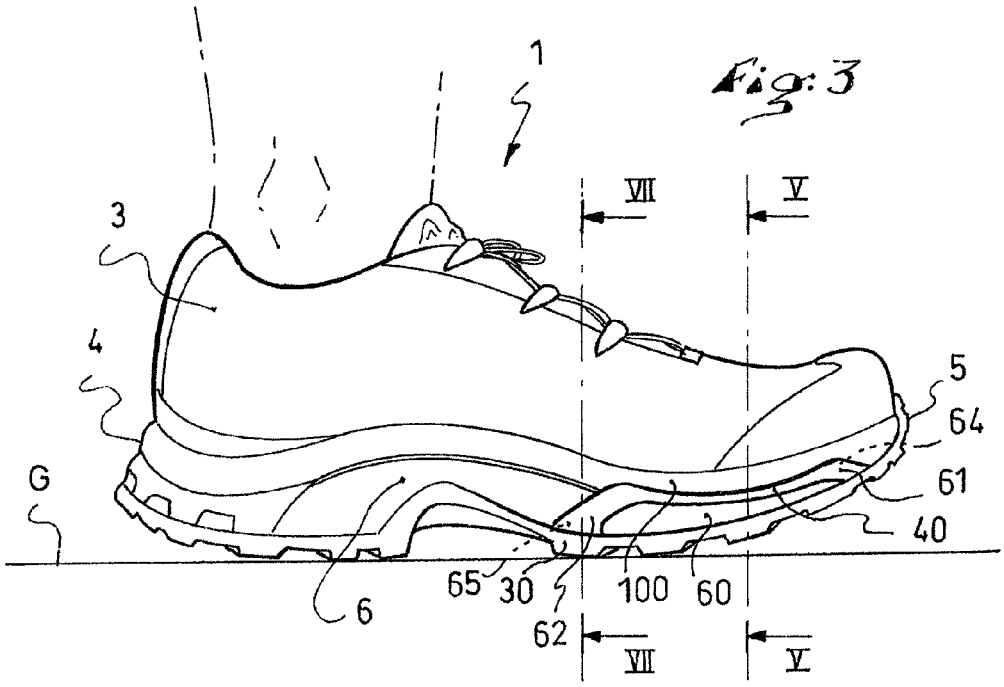
FIG. 3 is a side view of the shoe according to the first embodiment, in the case of an integral support on the ground.
Figure 4:
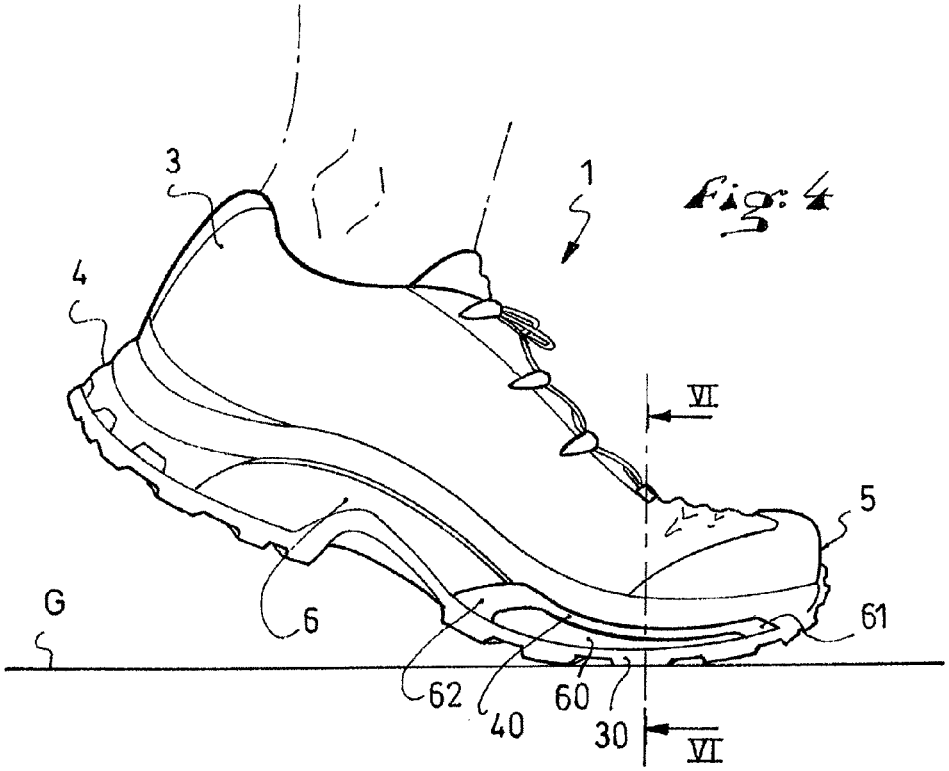
FIG. 4 is similar to FIG. 3, for a front support, the heel being raised.

FIGS. 3 and 4 clearly show the location of the flanges 61, 62, 64, 65 along the shoe. The first flanges, i.e., the lateral 61 and medial 64 flanges, are located in the area of the toes, forward of the articulations/joints which connect the toes to the metatarsus. The second flanges, i.e., the lateral 62 and medial 65 flanges, are located in the area of the metatarsus, rearward of the articulations which connect the toes to the metatarsus. Consequently, these articulations are located in a zone of the bottom assembly 2 that is not provided with flanges. In other words, these articulations are located in a zone of the bottom assembly where damping is substantial. This protects the articulations from the impulses that bias, toward compression, the bottom assembly. This arrangement is well-suited to shoes intended for foot races, which generate substantial dynamic impulses in the area of the articulations.

Generally speaking, such impulses are generated during walking. During foot rolling movement, i.e., the motion of the shoe between its configurations shown in FIGS. 3 and 4, the support of the shoe on the ground G varies. In fact, the shoe 1 moves alternately from a position in which the heel and the area of the metatarsus are supported, as shown in FIG. 3, to a position in which only the area of the articulations, between the toes and the metatarsus, are supported, as shown in FIG. 4.

Figure 5:
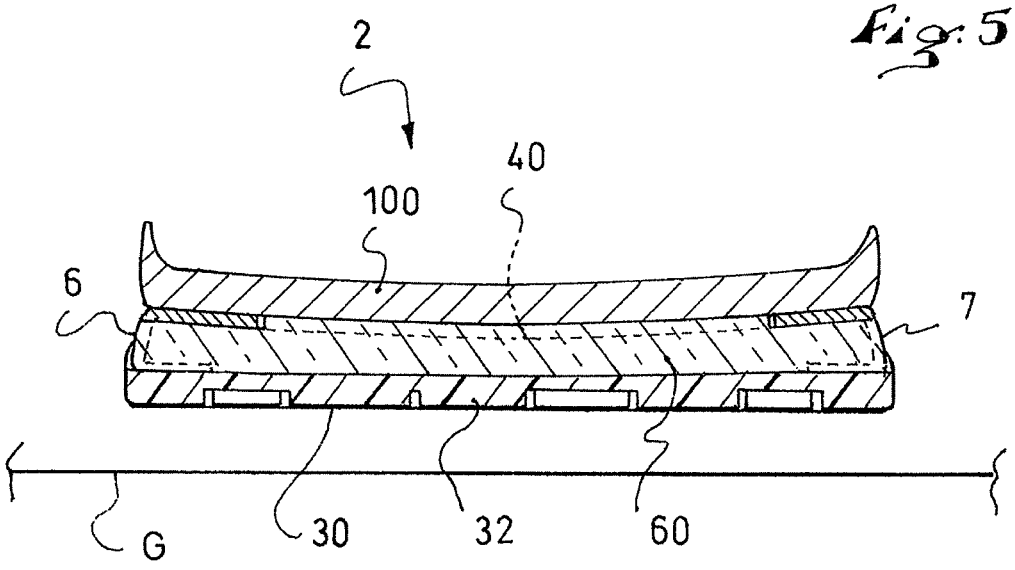
FIG. 5 is a partial cross section along the line V-V of FIG. 3.
Figure 6:
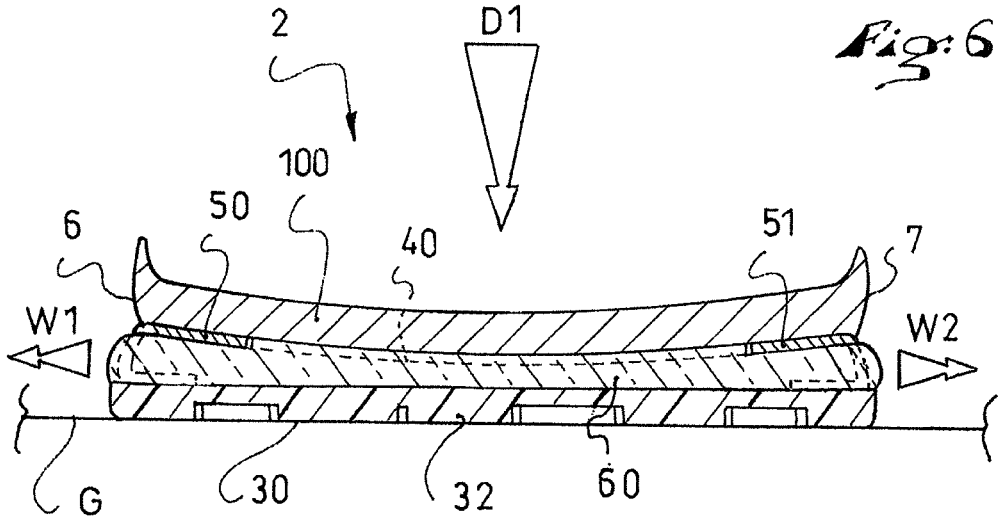
FIG. 6 is a partial cross section along the line VI-VI of FIG. 4.
Figure 7:
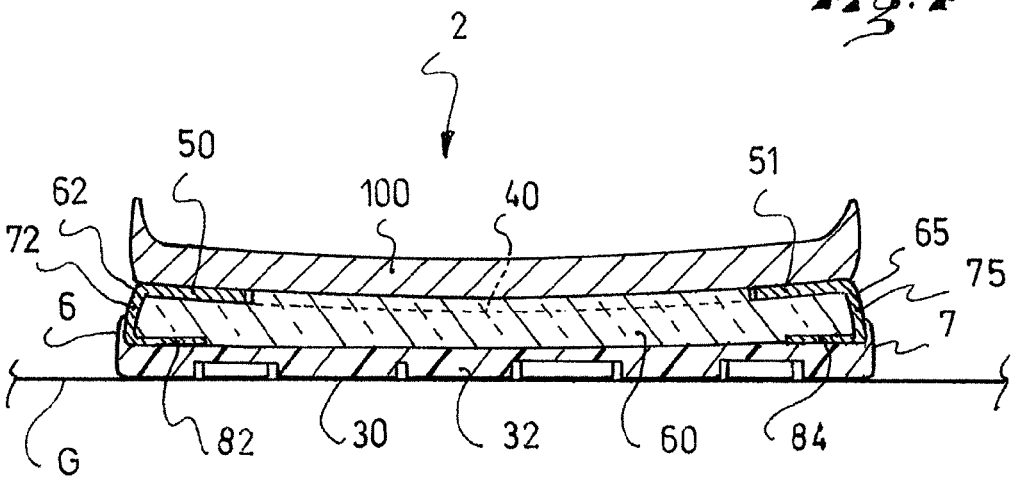
FIG. 7 is a cross section along the line VIII-VII of FIG. 3, in the case in which the bottom assembly is slightly biased in support, i.e., in which the bottom assembly experiences a slight downward force exerted by the wearer while opposed by the ground.
Figure 8:
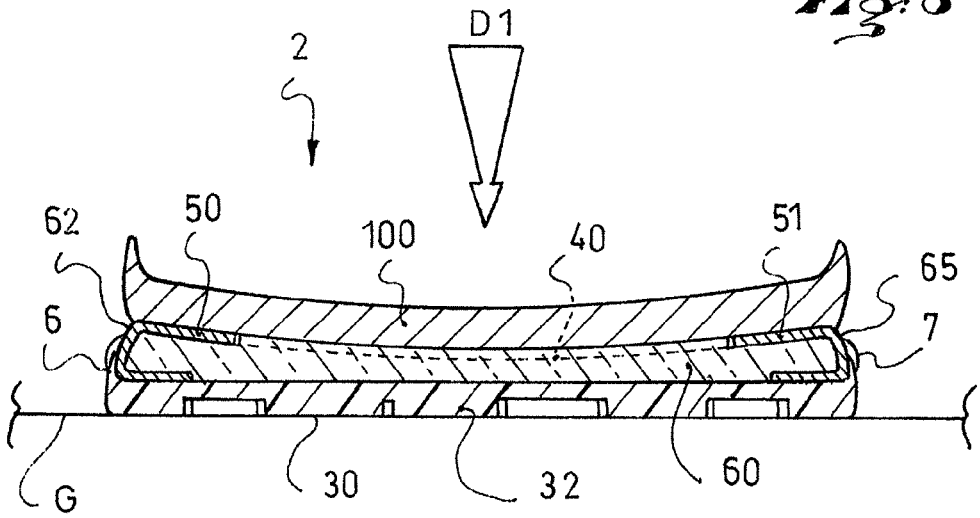
FIG. 8 is similar to FIG. 7, in the case in which the bottom assembly experiences a greater downward force than that of FIG. 7.

An impulse force that tends to flatten the bottom assembly 2 in the area of the articulations, between the toes and the metatarsus, is damped, as can be understood from FIGS. 5 and 6. In fact, the damping occurs depthwise of the bottom assembly 2. In FIG. 5, the bottom assembly 2 is in a nominal state: it is not subject to an impulse, but it withstands a load related to the user's weight. This is why the damping layer 60 is slightly compressed, or even not compressed at all. Conversely, FIG. 6 schematically shows a compression in the direction of the arrow D1. This compression results, for example, from pressure generated by an impulse, which means that the compression is brief. In this case, the damping layer 60 is flattened in the D1 direction, and widens in the direction of the arrows W1, W2. These deformations translate into shock absorption and, thus, comfort for the user.

Consequently, the zones of the bottom assembly 2 that are provided with flanges 61, 62, 64, 65 provide stability to the support pressures. Indeed, as can be understood from FIGS. 7 and 8, the flanges 62, 65 of a zone oppose compression along the thickness and widening along the width of the bottom assembly. Each flange 61, 62, 64, 65, with its leg and its base, opposes a deformation of the damping layer 60. This opposition is longitudinally localized in the area of the flanges, and transversely localized in the area of the arms 50, 51 of the reinforcement layer 40. In the transverse cross-sectional views of FIGS. 7 and 8, the flanges 62, 65 are shown extending from a position at least as high as an upwardly facing surface of the damping layer 60 to a position at least as low as a downwardly facing surface of the damping layer, thereby opposing deformation of the damping layer. In the particular embodiments shown, the flanges 62, 65 extend from the arms 50, 51 of the reinforcement layer 40 to an upwardly facing surface of the outsole 30.

It follows that the bottom assembly 2 brings comfort where necessary, as well as a high degree of precision in the transmission of the steering impulse forces by the wearer, as well as the sensory information where also necessary. The invention specializes various zones of the bottom assembly 2 with respect to the functions which they carry out. For the first embodiment, stability is desired in the area of the metatarsus and the toes, and comfort is desired in the area of the articulations between the metatarsus and the toes.

Figure 9:
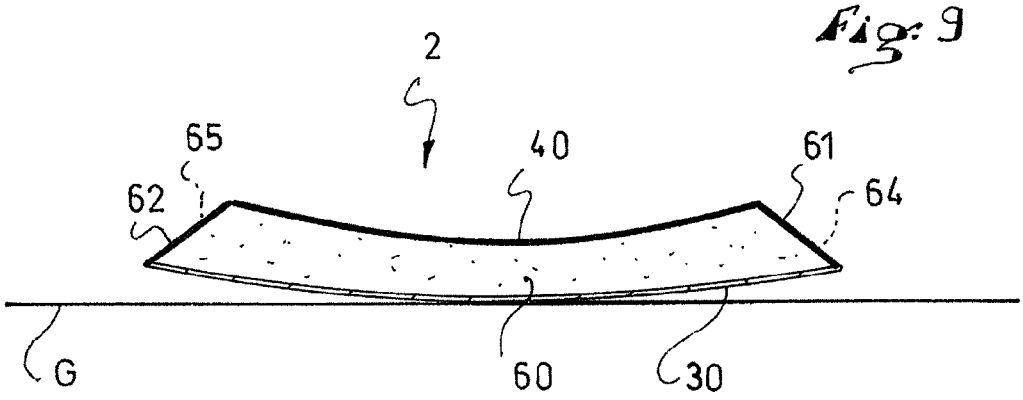
FIG. 9 is a partial schematic view of FIG. 3.
Figure 10:
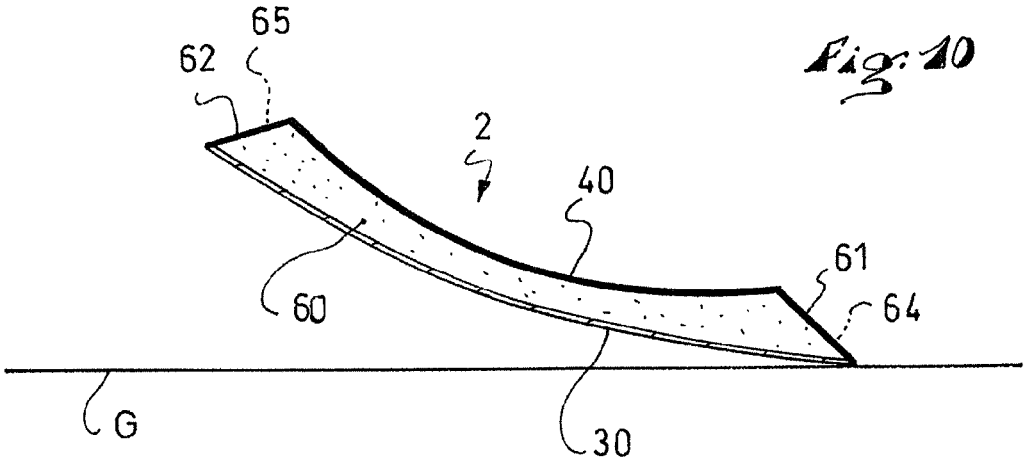
FIG. 10 is a partial schematic view of FIG. 4.

The invention also seeks to reduce the user fatigue, as can be understood from the diagrams of FIGS. 9 and 10. These diagrams are correlated with FIGS. 3 and 4, respectively. Thus, the bottom assembly 2 is seen in a rolling movement. When the bottom assembly 2 is flat on the ground G (comparable to the position shown in FIG. 3), the portion of the outsole 30 between the first lateral flange 61 and the second lateral flange 62 has a minimal length. The sole length is also minimal in the portion between the first medial flange 64 and the second medial flange 65. When the bottom assembly 2 is in support on the front (comparable to the position shown in FIG. 4), its convexity is accentuated. Consequently, the outsole 30 lengthens longitudinally between two flanges located on the same side 6, 7. The sole 30 therefore lengthens between the lateral flanges 61, 62 as well as between the medial flanges 64, 65. The sole 30 lengthens in a reversible fashion. The sole 30 behaves as a spring that is tensioned and, thereby, it accumulates energy. In practice, part of the energy, provided by the user in order to take support at the front, is accumulated by the sole 30. This accumulation is possible because two flanges located on the same side, and therefore their bases, move away from one another. As these bases are affixed to the sole 30, the sole becomes tensioned when the convexity of the bottom assembly increases.

Due to the elasticity of the outsole, the bottom assembly tends to reassume its natural shape at the end of the rolling movement. It is the action of the outsole 30 that reduces the convexity and which, at the same time, thrusts the shoe 1 forward. The elasticity of the outsole 30, exploited by the reinforcement layer 40 and the flanges 61, 62, 64, 65, enables a reduction in the fatigue for an equivalent stride. This phenomenon is possible because the sole 30 is elastic, because the flanges connect the reinforcement layer 40 to the sole 30, but also because a gap is provided between the sole 30 and the reinforcement layer 40. This gap is dependent upon the thickness of the damping layer 60. The thicker the latter, the more substantial the tensioning of the sole 30.

The other embodiments of the invention are shown hereinafter with reference to FIGS. 11 to 14. For reasons of convenience, the elements that are common with the first embodiment are designated by the same reference numerals.

Figure 11:
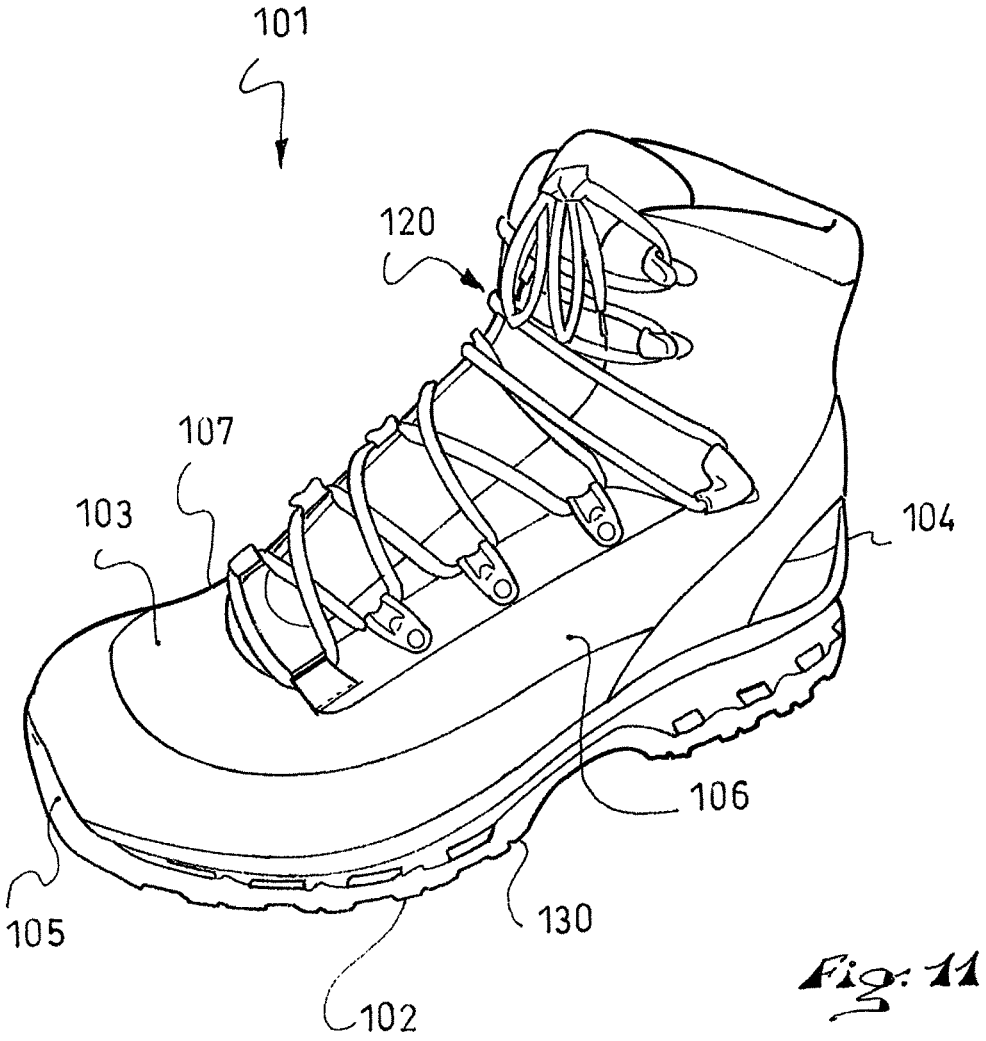
FIG. 11 is a perspective front view of a shoe according to a second embodiment of the invention.
Figure 12:
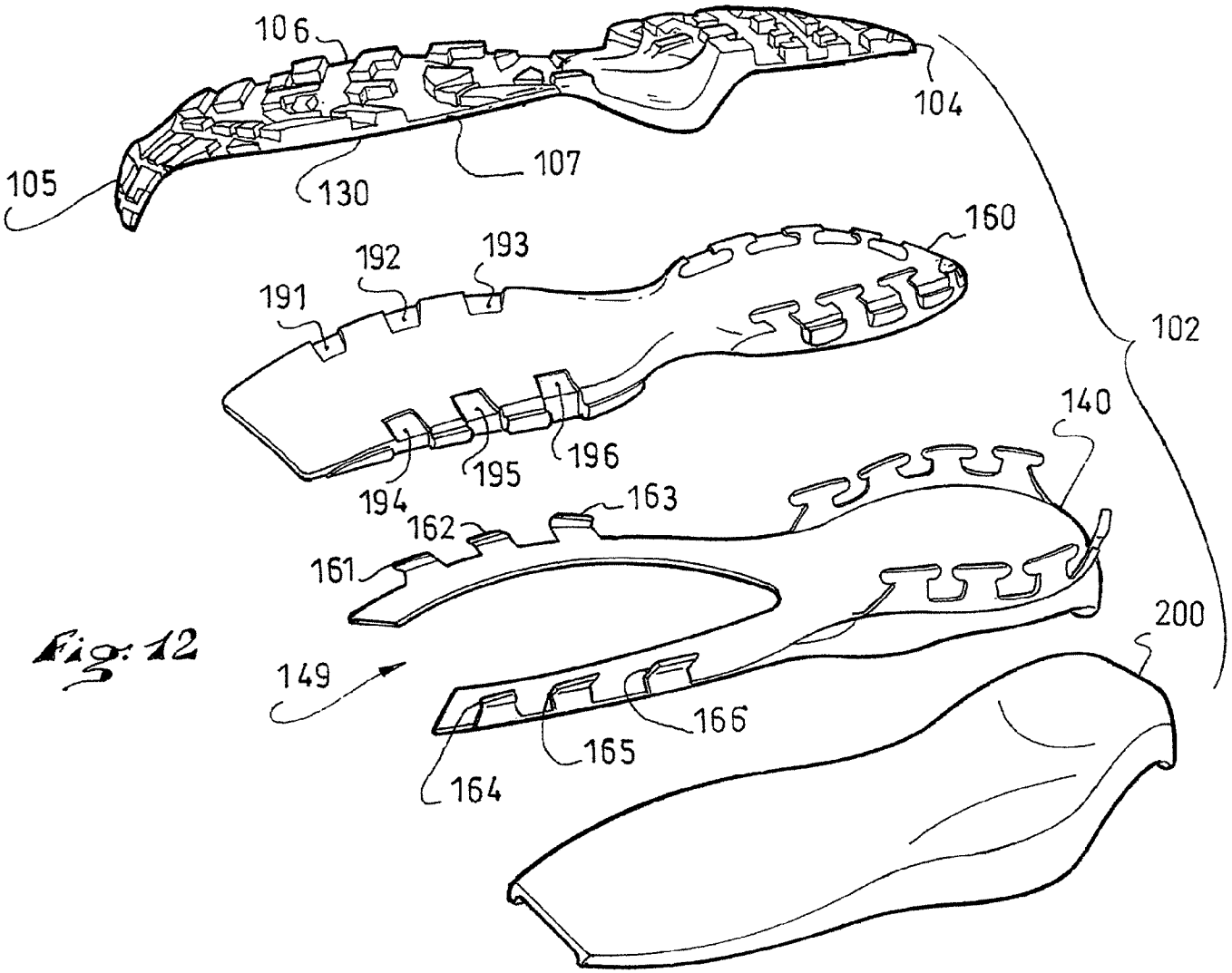
FIG. 12 is an exploded, perspective view of a bottom assembly of the shoe according to the second embodiment.

The second embodiment is described with reference to FIGS. 11 and 12. It relates to a shoe 101 that includes in particular a bottom assembly 102 and a high upper 103. The upper 103 is characterized as high because it covers the foot and extends above the ankle. The shoe 101 has a heel 104, a tip 105, a lateral side 106, and a medial side 107, as well as a tightening device 120. The bottom assembly 102 includes an outsole 130, a reinforcement layer 140, a damping layer 160, and a connecting layer 200.

Specific to the second embodiment is the number of flanges. More particularly, the shoe 101 includes six flanges located at the front, namely a first lateral flange 161, a second lateral flange 162, a third lateral flange 163, as well as a first medial flange 164, a second medial flange 165, and a third medial flange 166. The first flanges 161, 164, the second flanges 162, 165, and the third flanges 163, 166 are respectively opposite one another transversely.

As is the case with the first embodiment, the damping layer 160 has first 191, second 192, and third 193 lateral notches, as well as first 194, second 195, and third 196 medial notches. The notches receive the flanges. Given that the structures and the functions of the elements of the second embodiment are similar or identical to those of the first embodiment, they are not described in more detail. It is simply noted that the front portion 149 of the reinforcement layer 140 bears a larger number of flanges. Thus, the bottom assembly 102 of the shoe 101 has, in its front portion, alternating flexible zones and rigid zones, including three rigid zones. The rigid zones are demarcated by the extent of the flanges. It can also be said that the flanges follow one another along a relatively tight pitch. This arrangement is well-suited to walking on mountainous terrain, during which the front of the shoe presses on projecting rocks. The alternating flexible and rigid zones enable the bottom assembly to easily adapt to the unevenness of the ground. This improves the stability of the shoe.

Figure 13:
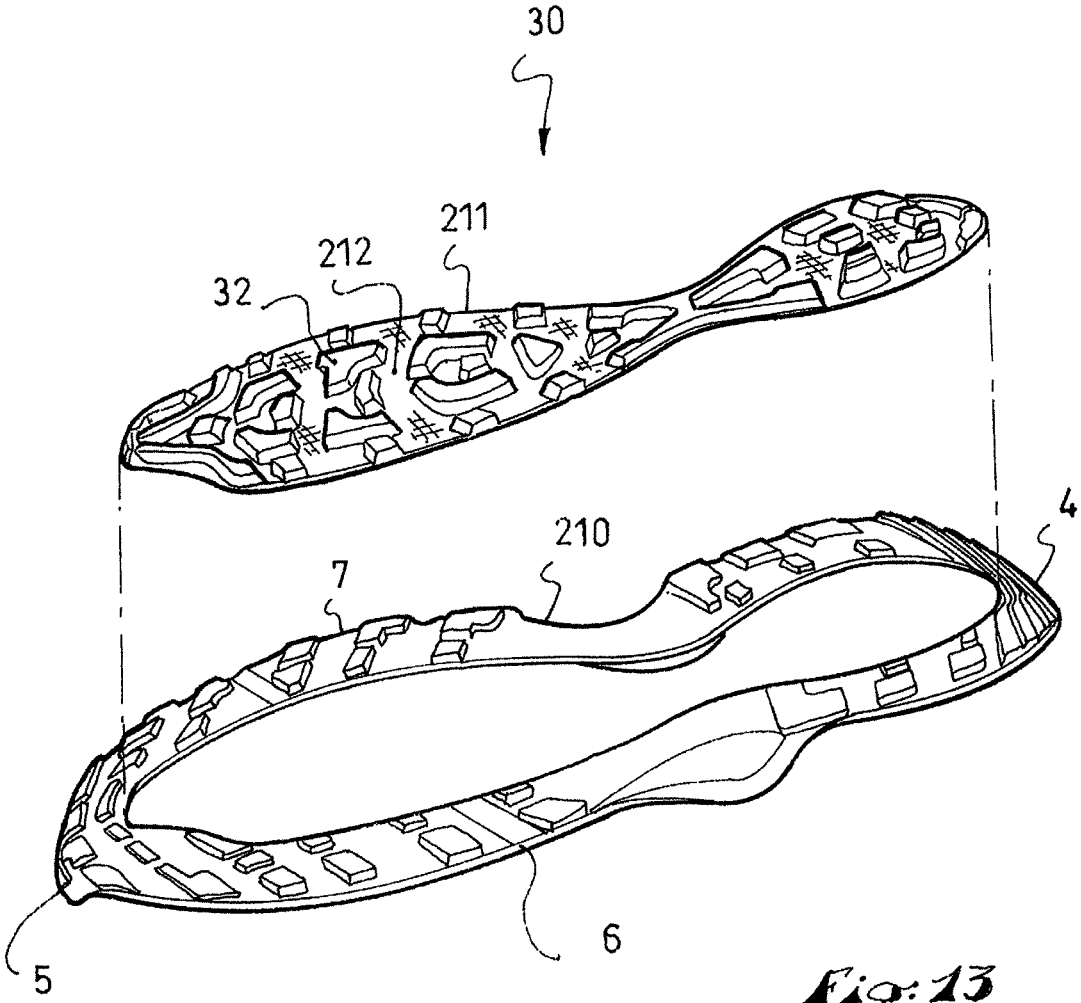
FIG. 13 is a partial exploded, perspective view of a bottom assembly for a shoe according to a third embodiment the invention.
Figure 14:
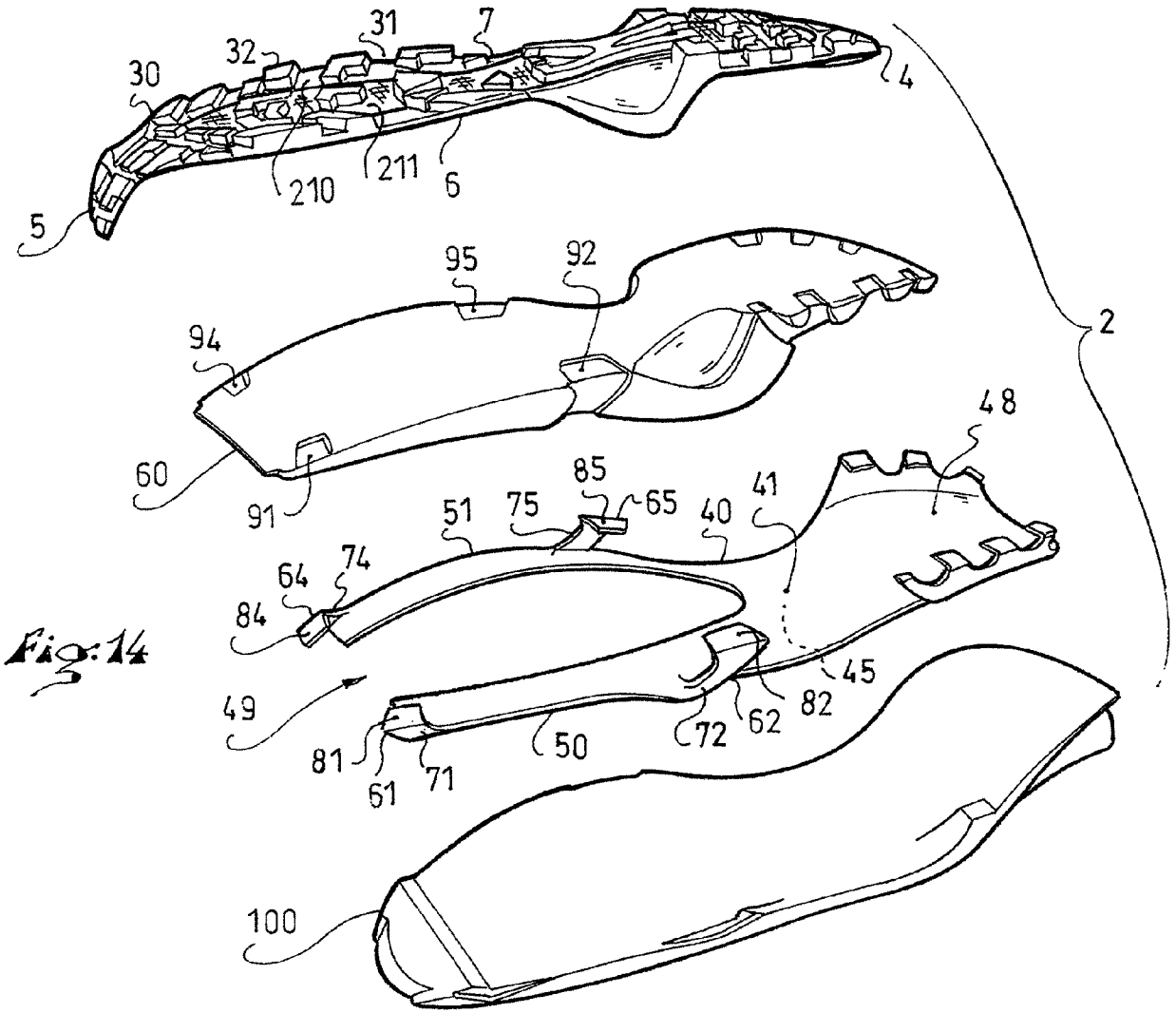
FIG. 14 is a more complete view of the bottom assembly according to the third embodiment.

The third embodiment is shown in FIGS. 13 and 14. This embodiment includes an alternative embodiment of the outsole 30. The latter includes several portions, namely a ring or crown 210 and a core 211. The crown extends lengthwise from the heel 4 to the tip 5, and widthwise from the lateral side 6 to the medial side 7. The crown includes an extensible flexible material, such as rubber or any equivalent. The core 211 includes a core plate 212 made of cloth, such as canvas, which bears studs or tread blocks 32. The core 212 is flexible but very slightly extensible, or not extensible at all. Thus, the energy accumulating and restoring effect is localized in the area of the sides 6, 7 of the shoe. In fact, the flanges are connected to the crown.

The core 211 is bordered by the crown 210. This provides a geometrical continuity to the sole 30.

The invention is made from materials and according to techniques of implementation known to those of ordinary skill in the art.

The invention is not limited to the particular embodiments described hereinabove and shown in the drawings, and includes all of the technical equivalents that fall within the scope of the claims which follow.

In particular, even if the flanges are located in the area of the front portion 49 of the reinforcement layer 40, 140, the number of flanges can be other than four or six. Flanges can be arranged on only one side of the shoe, i.e., whether lateral or medial. Flanges can also be arranged toward the middle of the shoe, i.e., such as halfway between the lateral edge and the medial edge.

Further, any structure can be provided for the manufacture of the flanges. For example, a flange does not necessarily form a unitary element with the reinforcement layer. In such a case, the flange is an assembled element of the bottom assembly. The flange can have a C-shaped structure, or any equivalent shape that facilitates the connection between the outsole and the reinforcement layer.

The invention, illustratively disclosed herein, suitably may be practiced in the absence of any element which is not specifically disclosed herein.

The invention claimed is:

1. An article of footwear comprising:
an outer bottom assembly comprising:
an outsole;
a reinforcement layer comprising:
a substantially inextensible material;
a rear portion in an area corresponding to a heel of a wearer;
a front portion extending forwardly of the rear portion;
a damping layer positioned between the outsole and the reinforcement layer, the damping layer comprising a compressible material;
at least one flange connecting the outsole to the reinforcement layer, the at least one flange being structured and arranged to oppose compression of the damping layer;
at least the one flange being located in the front portion of the reinforcement layer and spaced from the front end of the article of footwear;
the outsole, the damping layer, and the reinforcement layer being affixed to one another with adhesive.

2. An article of footwear according to claim 1, wherein:
the front portion of the reinforcement layer includes a lateral branch and a medial branch, said lateral and medial branches forming a forwardly open fork.

3. An article of footwear according to claim 1, wherein:
each of the at least one flange comprises a first portion forming a leg and a second portion forming a base.

4. An article of footwear according to claim 3, wherein:
a leg and a base extend from one to another, the leg projecting from the reinforcement layer and the base being parallel to the reinforcement layer, the base extending within the bottom assembly in the damping layer and in contact with the outsole.

5. An article of footwear according to claim 3, wherein:
the base extends from the leg transversely inwardly toward, but not through, a longitudinal median plane of the article of footwear.

6. An article of footwear according to claim 3, wherein:
the damping layer comprises a compressible material having a structure for damping impacts more greatly than the inextensible material of the reinforcement layer.

7. An article of footwear according to claim 3, wherein:
the at least one flange comprises a plurality of longitudinally spaced-apart flanges;
in longitudinally spaced-apart zones of the outer bottom assembly not having at least one of the plurality of flanges are damping zones;
each of the plurality of flanges is located in a reduced-damping zone.

8. An article of footwear according to claim 1, wherein:
the reinforcement layer includes a rear portion and forms, together with the rear and front portions, as well as the flanges, a unitary element made of the same material.

9. An article of footwear according to claim 1, wherein:
the damping layer includes a plurality of notches each provided to house a respective flange.

10. An article of footwear according to claim 1, wherein:
said at least one flange comprises at least four flanges.

11. An article of footwear according to claim 1, wherein:
said at least one flange comprises at least six flanges located at a front portion of the article of footwear.

12. An article of footwear according to claim 1, wherein:
the at least one flange comprises a plurality of flanges arranged in pairs extending in a direction transverse to a longitudinal median plane of the article of footwear.

13. An article of footwear according to claim 1, wherein:
the damping material comprises a foam material.

14. An article of footwear according to claim 1, wherein:
the foam material comprises EVA.

15. An article of footwear according to claim 1, wherein:
the at least one flange comprises at least two longitudinally spaced-apart flanges;
the bottom assembly is longitudinally elastic between the two longitudinally spaced-apart flanges.

16. An article of footwear according to claim 15, further comprising:
an upper secured to and extending above the outer bottom assembly;
the outer bottom assembly and the upper being relatively flexible to facilitate the rolling movement to facilitate a rolling movement of the article of footwear during walking.

17. An article of footwear according to claim 1, further comprising:
an upper;
the bottom assembly further comprising a connecting layer positioned between the upper and the reinforcement layer.

18. An article of footwear according to claim 1, wherein:
at least the one flange extends downwardly from the reinforcement layer to an outsole-supporting position on the outsole.

19. An article of footwear according to claim 18, wherein:
at least the one flange extends downwardly from the reinforcement layer to an upwardly facing surface of the outsole.

20. An article of footwear according to claim 1, wherein:
in transverse cross section, at least the one flange extends from a position at least as high as an upwardly facing surface of the damping layer to a position at least as low as a downwardly facing surface of the damping layer.

21. An article of footwear according to claim 1, wherein:
the at least one flange is made of the same material as the reinforcing layer.

22. An article of footwear according to claim 1, wherein:
the at least one flange comprises a plurality of flanges;
at least two of the plurality of flanges are positioned along respective ones of the lateral and medial branches of the front portion of the reinforcement layer.

23. An article of footwear according to claim 1, wherein:
the at least one flange comprises a leg and a base, the leg extending downwardly from the reinforcement layer in a direction toward the outsole;
the base extends at an angle from the leg and contacts the outsole.

24. An article of footwear comprising:
an outer bottom assembly comprising:
an outsole;
a reinforcement layer comprising a substantially inextensible material;

a damping layer positioned between the outsole and the reinforcement layer, the damping layer comprising a compressible material;

at least four flanges connecting the outsole to the reinforcement layer, each of the at least four flanges being structured and arranged to oppose compression of the damping layer;

said at least four flanges comprising a first lateral flange and a first medial flange located in an area corresponding to toes of a wearer of the article of footwear;

said at least four flanges further comprising a second lateral flange and a second medial flange located in an area corresponding to a metatarsus of the wearer;

the outsole, the damping layer, and the reinforcement layer are affixed to one another with adhesive.

25. An article of footwear according to claim 24, wherein:

the bottom assembly does not include a flange in an area corresponding to an articulation between the toes and the metatarsus of the wearer.

26. An article of footwear according to claim 24, wherein:

each of the at least four flanges comprises a leg and a base, the leg extending downwardly from the reinforcement layer in a direction toward the outsole;

the base extends at an angle from the leg and contacts the outsole.

27. An article of footwear comprising:

an outer bottom assembly comprising:

an outsole;

a reinforcement layer;

a damping layer positioned between the outsole and the reinforcement layer;

at least four flanges connecting the outsole to the reinforcement layer;

said at least four flanges comprising a first lateral flange and a first medial flange located in an area corresponding to toes of a wearer of the article of footwear;

said at least four flanges further comprising a second lateral flange and a second medial flange located in an area corresponding to a metatarsus of the wearer;

the reinforcement layer comprising:

a rear portion located in an area corresponding to a heel of the wearer;

a front portion connected to and extending forward of the rear portion, the front portion comprising a forwardly open fork, said fork comprising a lateral branch and a medial branch;

the four flanges being located at the front portion of the reinforcement layer.

28. An article of footwear according to claim 27, wherein:

the bottom assembly does not include a flange in an area corresponding to an articulation between the toes and the metatarsus of the wearer.

29. An article of footwear comprising:

an outer bottom assembly comprising:

an outsole;

a reinforcement layer;

a damping layer positioned between the outsole and the reinforcement layer;

at least one flange connecting the outsole to the reinforcement layer, the at least one flange being structured and arranged to oppose compression of the damping layer;

at least the one flange extending downwardly from the reinforcement layer to the outsole in an outsole-supporting position on the outsole;

the at least one flange being located in a front portion of the reinforcement layer and spaced from the front end of the article of footwear;

an entirety of the at least one flange being transversely spaced from a longitudinal median plane of the article of footwear.

30. An article of footwear according to claim 29, wherein:

at least the one flange extends downwardly from the reinforcement layer to an upwardly facing surface of the outsole.

31. An article of footwear according to claim 29, wherein:

in transverse cross section, at least the one flange extends from a position at least as high as an upwardly facing surface of the damping layer to a position at least as low as a downwardly facing surface of the damping layer.

32. An article of footwear according to claim 28, wherein:

the at least one flange comprises a leg and a base, the leg extending downwardly from the reinforcement layer in a direction toward the outsole;

the base extends at an angle from the leg and contacts the outsole.

33. An article of footwear comprising:

an outer bottom assembly comprising:

an outsole;

a reinforcement layer comprising:

a rear portion located in an area corresponding to a heel of the wearer; and a front portion connected to and extending forward of the rear portion, the front portion comprising a forwardly open fork, said fork comprising a lateral branch and a medial branch;

at least two flanges being located on respective ones of the lateral and medial branches of the reinforcement layer;

a damping layer positioned vertically between the outsole and the reinforcement layer and extending longitudinally at least from an area corresponding to a wearer's metatarsus to the wearer's toes;

means for providing an increased-damping zone;

means for providing longitudinally spaced-apart decreased-damping zones;

said means for providing longitudinally spaced-apart decreased damping zones comprising:

at least two flanges;

each of the two flanges connecting the outsole to the reinforcement layer;

each of the two flanges located in a respective one of two longitudinally spaced-apart decreased-damping zones;

said means for providing an increased-damping zone comprising a zone having none of said at least two flanges.

34. An article of footwear according to claim 33, wherein:

each of the at least two flanges extends downwardly from the reinforcement layer to an outsole-supporting position on the outsole.

35. An article of footwear according to claim 33, wherein:

each of the at least two flanges extends downwardly from the reinforcement layer to an upwardly facing surface of the outsole.

36. An article of footwear according to claim 33, wherein:

in transverse cross section, each of the at least two flanges extends from a position at least as high as an upwardly facing surface of the damping layer to a position at least as low as a downwardly facing surface of the damping layer.

37. An article of footwear according to claim 33, wherein:

the means for providing longitudinally spaced apart decreased damping zones comprises at least one flange in an area corresponding to toes of the wearer and at least one flange in an area corresponding to a metatarsus of the wearer;

the means for providing an increased damping zone comprises no flanges connecting the outsole to the reinforcement layer in an area corresponding to an articulation between the toes and the metatarsus of the wearer.

38. An article of footwear according to claim 33, wherein:

each of the at least two flanges comprises a leg and a base, the leg extending downwardly from the reinforcement layer in a direction toward the outsole;

the base extends at an angle from the leg and contacts the outsole.

39. An article of footwear according to claim 33, wherein:

each of the at least two flanges being structured and arranged to oppose compression of the damping layer.

* * * * *